United States Patent [19]

Christiansen et al.

[11] 4,007,607

[45] Feb. 15, 1977

[54] METHOD AND APPARATUS FOR KNITTING PATTERNED SLIVER HIGH PILE FABRIC

[75] Inventors: Paul Christiansen, Fort Washington; George K. Roshon, Woxall, both of Pa.

[73] Assignee: Hayes-Albion Corporation, Norristown, Pa.

[22] Filed: Oct. 9, 1975

[21] Appl. No.: 621,015

[52] U.S. Cl. ..... 66/9 B; 66/154 A; 66/132 R

[51] Int. Cl.[2] ..... D04B 9/12; D04B 9/14; D04B 9/16; D04B 9/44

[58] Field of Search ..... 66/9, 25, 154 A, 132, 66/50 R, 50, 40; 340/172.5, 174 DA, 174 LC, 174 ME; 235/151.1

[56] References Cited

UNITED STATES PATENTS

| | | | |
|---|---|---|---|
| 1,848,370 | 3/1932 | Moore | 66/9 |
| 3,010,297 | 11/1961 | Hill | 66/9 |
| 3,016,522 | 1/1962 | Lourie | 360/50 |
| 3,232,079 | 2/1966 | Leuiwe et al. | 66/154 A |
| 3,299,672 | 1/1967 | Schmidt | 66/9 |
| 3,446,037 | 5/1969 | Sutton | 66/25 |
| 3,601,808 | 8/1971 | Vlach | 340/172.5 |
| 3,662,348 | 5/1972 | Weiss | 340/172.5 |
| 3,709,002 | 1/1973 | Brandt et al. | 66/9 B |
| 3,762,184 | 10/1973 | Schur et al. | 66/86 C |
| 3,821,526 | 6/1974 | Anderson | 66/25 |
| 3,825,900 | 7/1974 | Anderson | 66/25 |
| 3,844,139 | 10/1974 | DeCejat et al. | 66/50 R |

FOREIGN PATENTS OR APPLICATIONS

| | | | |
|---|---|---|---|
| 1,474,081 | 2/1967 | France | 66/50 R |
| 1,522,413 | 3/1968 | France | 66/50 R |
| 1,194,731 | 5/1967 | United Kingdom | 66/25 |

*Primary Examiner*—Ronald Feldbaum
*Attorney, Agent, or Firm*—Robert B. Frailey

[57] ABSTRACT

The present invention provides a method and apparatus for controlling selectively the sliver feeding rates of the carding mechanisms of a multi-feed high pile fabric circular knitting machine, whereby the sliver feeding rates harmonize continuously with the fabric pattern for which the machine has been programmed. The selected pattern is incorporated into the fabric during knitting by electronically controlled needle selection. The knitting pattern data is stored in digital form in a computer type memory, such as a magnetic disc, tape or drum, or equivalent digital data storage means. The rate of sliver feed at each sliver feeding station is determined continuously during knitting, and adjusted as required, by the pattern data controlling the needle selection at that particular station, to ensure that the sliver input to the machine harmonizes with the demand of the needles for sliver fibers in accordance with the knitting pattern selected. The sliver feed rate also is controlled in accordance with the speed of rotation of the needle cylinder and the fabric density desired.

8 Claims, 3 Drawing Figures

METHOD AND APPARATUS FOR KNITTING PATTERNED SLIVER HIGH PILE FABRIC

SUMMARY OF THE INVENTION

The primary object of this invention is to provide a new and improved control for a multi-feed sliver high pile fabric circular knitting machines, for controlling selectively the rates of feed of plural rovings or slivers to the needles of the machine.

A further object of the invention is to provide a new and improved method for feeding sliver to a high pile fabric circular knitting machine, in which the rate of sliver feed is proportioned automatically to the electronically controlled needle selection for which the machine is programmed, to produce patterned high pile fabric.

A further object of the invention is to provide a new and improved sliver feeding means for multi-feed high pile fabric circular knitting machines, in which the sliver feed rolls are driven at selected rates of feed, and/or during selected intervals of time, by electronically controlled stepping motors.

A further object of the invention is to provide a new and improved method for feeding sliver at selected rates to selected needles of a high pile fabric circular knitting machine, in which each rate of sliver feed is controlled continuously and automatically during knitting, whereby the rate at which the sliver is fed harmonizes with the demand of the needles for sliver fibers in accordance with any selected fabric pattern.

A further object is to provide an electronically controlled multi-feed sliver high pile fabric circular knitting machine for knitting patterned fabrics, in which the electronic controls for the machine calculate continuously the rates of sliver feed at each sliver feeding station proportional to, and in accordance with, the rate of rotation of the needle cylinder and the selected pile density and patterning of the fabric being knit.

A further object is to provide a new and improved electronic controlled pattern system for a multi-feed sliver high pile fabric knitting machine, which dispenses with the necessity of storing in the control system separate data for controlling the rates of feed of the plural rovings or slivers to the knitting machine needles.

To achieve the foregoing objectives, the invention in its preferred form utilizes separate electronically controlled stepping motors for driving at selected speeds the feed rolls of each separate sliver feeding mechanism. The knitting machine is programmed to knit selected high pile fabric patterns by electronically controlled needle selection, wherein the knitting pattern data, comprising needle clear and welt indications, are stored in a computer type memory, such as a rotatable magnetic disc, or equivalent digital data storage means. A separate data transfer electronic circuit is interposed between the memory and each stepping motor, whereby digital pattern data is transferred from the memory to the stepping motors of each sliver feeding mechanism. By reason of the electronic control provided, each stepping motor driving each set of sliver feed rolls is regulated continuously during knitting of the fabric. A train of pulses proportional to the speed of rotation of the needle cylinder is introduced into the data transfer circuit to ensure that the selected rates of speed of the sliver feed rolls are proportional to the speed of rotation of the needle cylinder. Further. input means are provided to ensure that the patterned pile fabric is knit in accordance with any selected pile density. Thus, the rate of sliver feed is controlled by the rotative speed of the needle cylinder, the fabric density desired and the demand of the needles for sliver fibers according to the fabric pattern selected.

DEFINITIONS

The following definitions will be applicable herein:

The terms "carding mechanism" and "cards" will indicate the sliver feeding means or mechanism for feeding a roving or sliver to the needles of a high pile fabric knitting machine.

The term "change point" will have the same meaning as used in Paul Christiansen U.S. Pat. No. 3,940,951, entitled "Knitting Machine Control," to indicate the point on the needle cylinder of a circular knitting machine, or in the fabric produced thereby, where one course of the fabric ends, and the next succeeding fabric course begins, at a specific yarn feed of the machine.

The term "welt level" will indicate the relatively low level at which a needle is located in the needle cylinder, whereby it is too low to receive either sliver fibers or yarn in its hook. Welt level indicates the "non-knit" condition of a needle in terms of needle selection.

The terms "clear" and "clearing level" will indicate the level to which a needle rises to receive sliver fibers from a card.

The term "tuck level" will indicate the position of a needle in the needle cylinder anywhere between clear level and welt level.

The terms "rate of sliver feed," "sliver feeding rate," and similar terms will indicate the average speed of the stepping motors, which drive the sliver feed rolls, computed or measured over a selected number of needles "*a*" of the knitting machine.

DETAILED DESCRIPTION OF THE INVENTION

Figure 1:
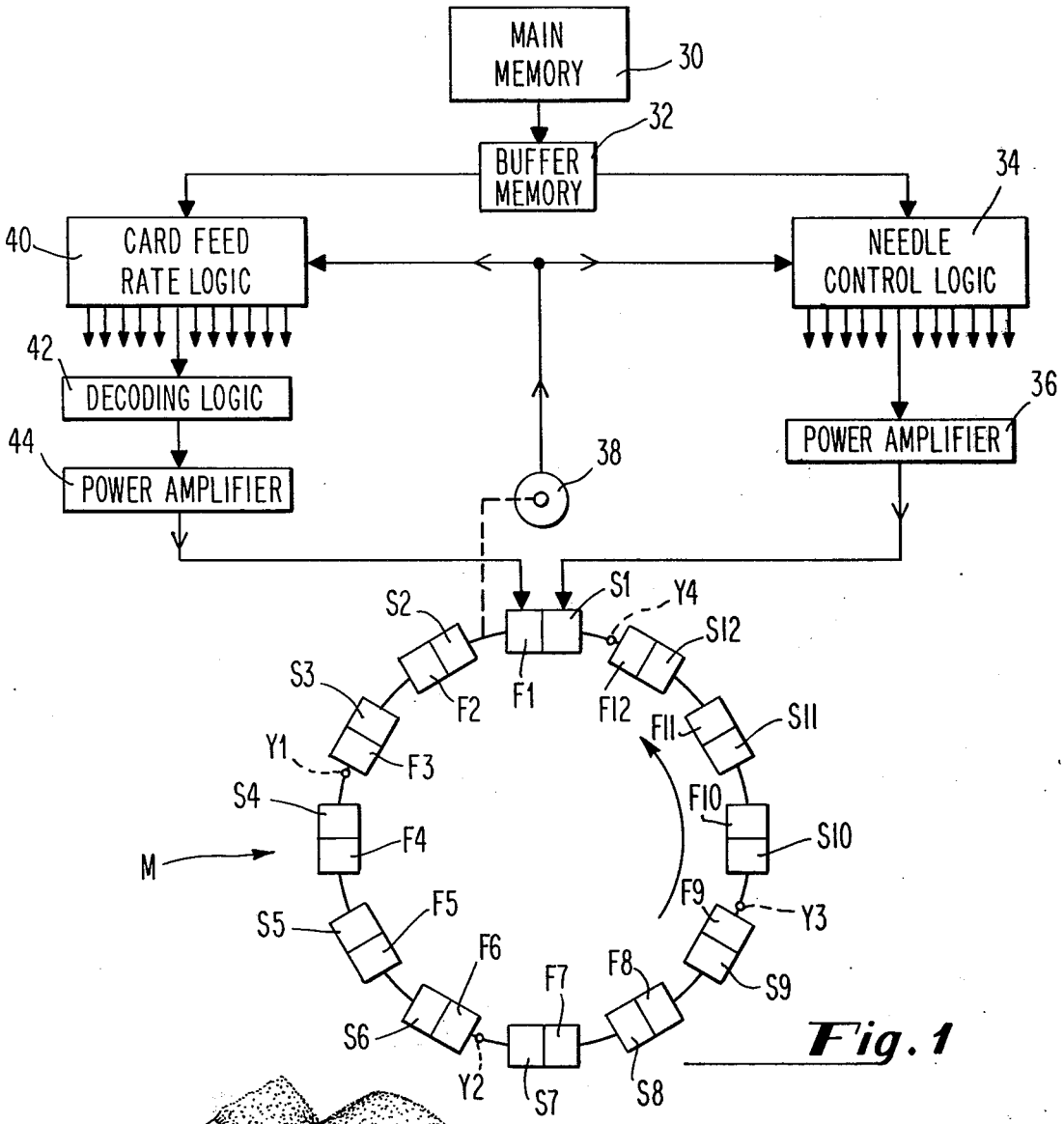
FIG. 1 is a schematic diagram illustrating a 12 head sliver high pile fabric circular knitting machine and its electronic control apparatus.

In FIG. 1, by way of illustration, there is shown schematically in top plan the knitting head of a multi-feed sliver high pile fabric circular knitting machine M having a plurality of independent latch needles (not shown) mounted in a circle in a conventional needle cylinder (also not shown), with capacity for selected reciprocal movement. The cylinder is rotatable in the direction of the curved arrow. The knitting machine is of the general type illustrated in Hill, U.S. Pat. No. 3,010,297.

Figure 3:
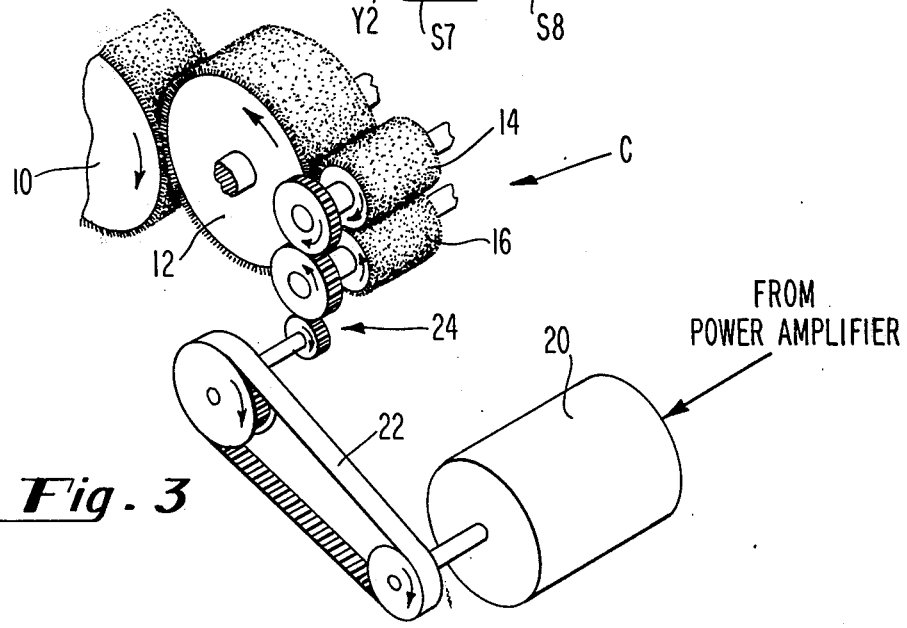
FIG. 3 is a fragmentary, partially schematic view in perspective, showing the stepping motor drive for a pair of sliver feed rolls of a sliver feeding mechanism.

In the embodiment shown, the machine M is provided with 12 sliver feeding stations, F1 to F12 inclusive, spaced at uniform intervals around the needle cylinder. Each such station includes a card C (FIG. 3) having the usual wire-covered rotatable doffer 10 and main cylinder 12, and a pair of rotatable, wire-covered sliver feed rolls 14, 16. The latter transfer a roving or sliver (not shown) from a source or supply via the main cylinder 12 to the doffer 10 for delivery to selected needles, in a manner illustrated in the Hill patent aforesaid. The feed rolls are driven by a stepping motor 20 through a conventional timing belt drive 22 and conventional gearing 24.

Disposed at each sliver feeding station F1–F12, in advance of its card C, are needle selecting mechanisms S1 to S12, respectively. Preferably, each needle selecting mechanism comprises an interchangeable module containing a vertical column of plural individual electromagnetic needle selecting actuators of the type illustrated in Christiansen, U.S. Pat. No. 3,896,639.

The electronic control apparatus for the machine M includes a control of the type illustrated in Christiansen U.S. Pat. No. 3,940,91 aforesaid, for selecting needles to produce a predetermined fabric pattern. The needle selection control includes a main memory 30, which may comprise a rotatable magnetic disc, a buffer memory 32 and needle control logic circuitry 34, the latter being connected electrically by conventional circuitry to each separate electromagnetic actuator of the needle selecting mechanisms S1 to S12 inclusive. As illustrated in FIG. 1, a power amplifier 36 is interposed in the circuit connecting each needle selecting actuator to the needle control logic circuitry 34. In the interest of brevity, only one circuit is shown in FIG. 1 connecting the needle control logic 34 to an electromagnetic needle selecting actuator (at S1). It is to be understood that a separate circuit connects each needle selecting actuator to the needle control logic circuitry. Thus, if each needle selecting mechanism S1–S12 includes 8 individual actuators, a total of 96 separate circuits are required.

The main memory 30 stores digital pattern data which is transferred from the memory to the individual electromagnetic actuators of the several needle selecting mechanisms S1 to S12 inclusive, to select needles at each sliver feeding station F1–F12. Data may be transferred from the main memory 30 to the electromagnetic actuators in response to signals generated by an absolute encoder 38 geared to the knitting machine M. In place of the absolute encoder 38, a pulse generator or equivalent means may be utilized to generate a train of pulses, proportional to the speed of rotation of the needle cylinder, to enable sequentially the several actuators of the successive needle selecting mechanisms S1–S12.

The electronic control apparatus for the knitting machine M also includes control circuitry for regulating continuously the speed of rotation of the stepping motors 20 associated with each of the 12 cards C, to control selectively the rate of sliver feed at each station F1–F12. The electronic control for the stepping motors includes card feed rate logic circuitry 40, connected electrically to each stepping motor 20 by separate circuitry which includes decoding logic circuitry 42 and a power amplifier 44. The decoding logic 42 decodes the pulse train from the card feed rate logic circuitry 40 to the input form required by the stepping motors 20. Each amplifier 44 in the circuit between the card feed rate logic and its stepping motor amplifies the decoded signals to a power level required by the stepping motor.

For the purpose of illustration, only one circuit is shown in FIG. 1 connecting the card feed rate logic 40 to one of the stepping motors 20 at a sliver feeding station (F1). It is to be understood that a separate circuit, each provided with its own decoding logic 42 and power amplifier 44, connects each stepping motor 20 of each card C to the card feed rate logic circuitry.

To ensure that the sliver feeding rates of the 12 cards C are at all times proportional to the speed of rotation of the needle cylinder, the card feed rate logic circuitry 40 is clocked by a signal directly proportional to the rotative speed of the needle cylinder. In the electronic control apparatus illustrated in FIG. 1, the pulse output of the absolute encoder 38 is utilized to provide the needle clock input to the card feed rate logic. But any suitable train or series of pulses proportional to the speed of rotation of the needle cylinder may be utilized, such as a clock pulse generator, for example.

Figure 2:
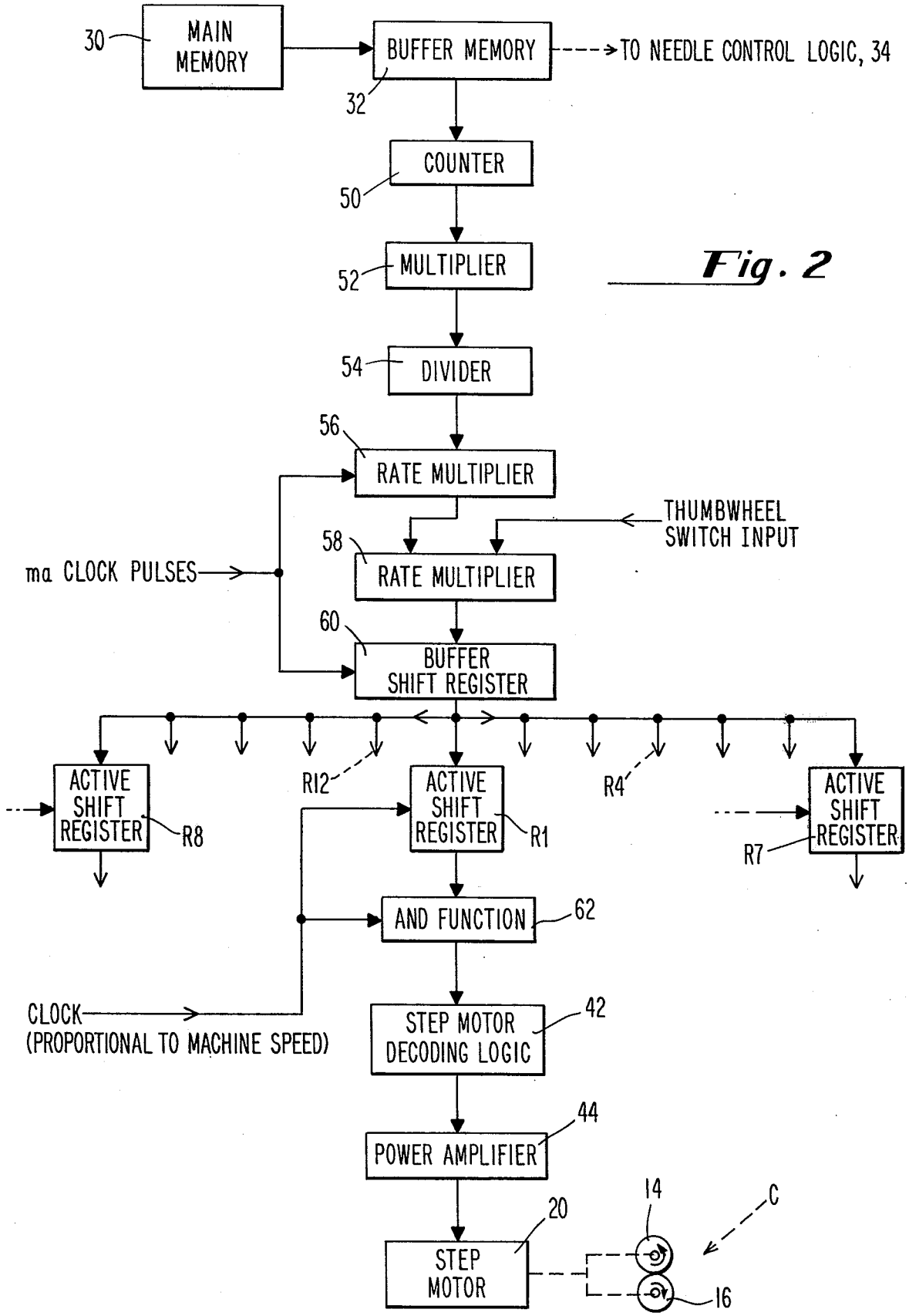
FIG. 2 is a schematic block diagram illustrating functionally the data transfer circuitry for controlling the rates of feed of the sliver feed rolls of each sliver feeding mechanism of the knitting machine.

FIG. 2 is a schematic block diagram illustrating functionally the data transfer circuitry for controlling the sliver feed rate at one of the cards C of the knitting machine M, for example at station F1. The card feed rate logic circuitry 40 is depicted in FIG. 2 by the functional block diagram interposed between the buffer memory 32 and the stepping motor decoding logic 42.

As explained in Christiansen, U.S. Pat. No. 3,940,951 aforesaid, digital pattern data for the electronically controlled knitting machine M is stored in the main memory 30. This digital pattern includes individual needle clear (knit) and needle welt (non-knit) instructions which control the needle selection during the knitting for any predetermined fabric pattern. The pattern data is stored in the main memory 30 in binary form where a binary "1"0 is a needle command to clear, i.e. a command to an electromagnetic needle selecting actuator to function to cause the needle to rise to clearing level to receive in its hook sliver fibers from the doffer 20 of the card C. A binary "0" of the pattern data is a needle command to welt. The pattern data is transferred from the main memory 30 in bytes (i.e. groups of discrete commands or "bits") necessary to supply pattern data to the needle selecting mechanism S1 at the sliver feeding station F1 where the card C is located. Each byte transferred supplies needle pattern data for one revolution of the needle cylinder. Because the pattern data is transferred from the main memory for each sliver feeding station before the change point in the fabric reaches that station, the data must be transferred to and stored in the buffer memory 32 until it is needed.

The data transferred to the buffer memory 32 is used to calculate the sliver feed rate for the card C preparatory to the next revolution of the needle cylinder during which the card feeds sliver to selected needles. After the pattern data has been read from the main memory 30 and stored in the buffer memory 32, the calculations for determining the sliver feeding rate of the card C for the next revolution proceeds by the following process: A selected number *a* of bits, i.e. discrete needle commands for *a* needles to clear or welt, is read from the buffer memory 32 by a counter 50, which counts the number of clear commands (binary 1's). Thereupon, the number of clear commands are multiplied by 100 by the multiplier 52 and then divided by the divider 54 by the selected number *a*. The number resulting from the multiplication and division of the clear commands is obtained as a binary coded decimal number.

The same binary coded decimal number also may be achieved, of course, by multiplying the clear commands by 10 and then dividing the resulting number by $a/10$.

The binary coded decimal number thus obtained is applied to the input of a rate multiplier 56, preferably composed of a cascaded set of decade rate multipliers. Clock impulses at the rate of *ma* are applied to the cascaded decade rate multiplier 56. In the designation *ma*, *m* is a selected constant comprising a scaling factor to provide a desired or preferred rate of pulses according to the particular conditions and characteristics of the knitting machine M. The symbol *a* of the designation *ma* indicates the commands for the selected number of needles *a*, to clear or welt, read from the buffer memory 32, referred to previously.

The output obtained from the rate multiplier 56 is applied to a second rate multiplier 58, the latter also preferably comprising a cascaded set of decade rate multipliers. Also applied to the second rate multiplier 58, as a binary coded decimal number, is an input indicating the desired density of the pile of the fabric to be knit. This latter input is applied selectively to the rate multiplier 58, for example by the selective setting of a set of thumbwheel switches (not shown), or equivalent means, of any suitable type. The output obtained from the second rate multiplier 58 is delivered to and stored in the buffer shift register 60, to which also are applied the *ma* clock impulses previously referred to, applied to the first rate multiplier 56. The buffer shift register 60 now contains a group of rate data *ma* bits long.

The foregoing process is repeated, beginning with the reading of a second number or series of *a* bits or needle commands from the buffer memory 32 by the counter 50. The process is repeated continuously until the total number of bits or needle commands read from the buffer memory 32 by the counter 50 is equal to the number of needles in the needle cylinder. At this point, the buffer shift register 60 may contain several groups of rate data, each *ma* bits long. The total of this rate data comprises the pattern data for controlling the card C for the next succeeding revolution of the needle cylinder relative to sliver feeding station F1.

The card feed rate logic circuitry 40 includes 12 active shift registers R1 to R12 inclusive, one for each of the stepping motors 20 of the 12 cards C. At a point which is a selected number of needles before the change point on the needle cylinder reaches the upcoming sliver feed, the rate data is transferred from the buffer shift register 60 to the appropriate active shift register. In the illustration described above, the rate data is transferred to the active shift register R1, which controls the stepping motor 20 of the card C at sliver feeding station F1.

The rate data transferred from the buffer shift register 60 to the active shift register R1 controls the sliver feed rate of the card C for one revolution of the needle cylinder of the machine M. The rate data is transferred to the active shift register R1 at a point in time which is a selected number of needles before the change point reaches sliver feeding station F1. This activates the stepping motor 20, whereby feed rolls 14, 16 of card C commence feeding sliver at the selected rate. This advanced actuation of the stepping motor 20, before the change point reaches station F1, compensates for the time required for the delivery of sliver through the card C to the selected needles.

The active shift register R1 is clocked by the pulse output of the encoder 38. As previously explained, this clock or pulse train is proportional to the speed of rotation of the needle cylinder. The data output of the active shift register R1 is combined with the needle clock as indicated by the "and" function block 62. The resulting pulse train is decoded by the stepping motor decoding logic 42 and amplified by the power amplifier 44, to drive the motor 20 at the speed necessary for card C to feed sliver at a selected rate in harmony with the fabric pattern selected. In the arrangement described, the binary 1's transferred from the active shift register R1 function to rotate the stepping motor one step for each 1. The result is to provide a card, with selectively and continuously controlled sliver feed roll drive means, designed to ensure that the sliver input to the machine harmonizes with the demand of the needles for sliver fibers, in accordance with the knitting pattern.

It is to be understood that the foregoing explanation of the manner in which data is transferred and utilized, for controlling the sliver feed rate of the card C at sliver feeding station F1, is equally applicable in respect to the control of the rates of sliver feed at the other sliver feeding stations F2 to F12, respectively.

The following example will illustrate an application of this invention to the 12 card knitting machine M illustrated in FIG. 1. In this example, it is assumed that the needle cylinder contains 1000 needles, that a three color fabric pattern is to be knitted and that the pattern repeat is 300 wales wide. Thus, the pattern will be repeated 3⅓ times around the circumference of the needle cylinder.

The number of cards required to provide sliver fibers for one complete course of fabric may be called a "feed group." In the present example, where a three color pattern is being knitted, there are three cards C per feed group. Four courses of fabric are knitted per revolution of the needle cylinder. Thus, the cards at sliver feeds F1, F2, F3 form the first course; the cards at feeds F4, F5, F6 form the second course; the cards at feeds F7, F8, F9 form the third course; and the cards at feeds F10, F11, F12 form the fourth course. Sliver feeds F1, F4, F7, F10 feed sliver of the first color; feeds F2, F5, F8, F11 feed sliver of a second color; and feeds F3, F6, F9, F12 feed sliver of a third color. The backing yarn, which anchors the sliver fibers in the fabric, is fed to the needles and knitted at the last feeding station of each feed group. In the example illustrated in FIG. 1, yarns Y1, Y2, Y3, Y4 are fed to the needles at stations F3, F6, F9, F12, respectively.

As pointed out previously, each feed group of cards C feeds sliver fibers during one revolution of the needle cylinder. While only a selected number of needles are raised to clear level at each sliver feed, to receive sliver fibers, all needles of the machine clear and take sliver fibers at one of the feeds during their rotation relative to the feed group. Where, as in the present example, a three color pattern is being knitted, the percentage of needles raised to clear level at each sliver feed of the feed group is represented as follows:

percent of needles cleared at sliver $$\text{feed } F1 = (K1/a) \times 100$$

percent of needles cleared at sliver $$\text{feed } F2 = (K2/a) \times 100$$

percent of needles cleared at sliver $$\text{feed } F3 = (K3/a) \times 100$$

wherein:

*K1* is the number of needles cleared at station F1;

$K2$ is the number of needles cleared at station F2;
$K3$ is the number of needles cleared at station F3; and
$a$ has the meaning defined previously, and could equal the total number of needles in the needle cylinder, i.e. 1000 in this particular instance.

It follows from the above that $K1 + K2 + K3 = a$.

To improve the uniformity of density of the pile, and thereby improve the quality of the fabric being knit, the selected number $a$ of needles utilized for determining the sliver feed rate ratio preferably should be reduced significantly below the total number of needles in the needle cylinder. For example, substantially improved results in uniformity of pile density will be achieved if the selected needle number $a$ is reduced from 1000 to 200. Therefore, if 200 needles pass through the first feed group, and K1 of these needles clear at feed F1, K2 clear at feed F2 and K3 clear at feed F3, the percentage of needles cleared at each feed is as follows:

$$F1(\%) = (K1/200) \times 100$$

$$F2(\%) = (K2/200) \times 100$$

$$F3(\%) = (K3/200) \times 100$$

Since, in accordance with this invention, the rate of sliver feed harmonizes with the demand of the needles for sliver fibers, both the rate of sliver usage and the rate of sliver feed at each feed station will be at the same percentage of the maximum rate of sliver feed of $a/a$. The feed rate percentages at which the cards C at feeds F1, F2, F3 of the first feed group feed sliver, due to needle selection, will be as follows:

$$C1(\%) = (K1/a) \times 100$$

$$C2(\%) = (K2/a) \times 100$$

$$C3(\%) = (K3/a) \times 100$$

In addition, the sliver feed rate for each card C also is controlled by the speed of rotation of the needle cylinder and by the desired pile density of the fabric. Thus, the sliver feed rate ($cr$) of each card C will be determined by the following equation:

$$cr(\%) = (n \times d \times (k/a)\ 100$$

wherein:

$n$ = machine speed/maximum machine speed $d$ = desired density/maximum density $k$ is the number of needles selected to be raised to clear level, equalling the number of binary 1's in the $a$ bits read by counter 50 from the buffer memory 32; and
$a$ is the selected number of needles (i.e. needle commands or bits previously defined).

It follows that the selected speed of each stepping motor 20 of each card C is provided by the following factor:

$$m(n \times d \times (k/a)$$

wherein:
$m$ is the scaling factor constant previously defined; and
$n$, $d$, $k$ and $a$ are as defined immediately above.

As explained in Hill U.S. Pat. No. 3,010,297 aforesaid, after a selected number of needles $k$ have cleared and taken sliver fiber in their hooks at one sliver feed in a feed group, they are lowered to tuck level. They remain at tuck level until they are fed the base or backing yarn, at the last feeding station of the feed group.

Referring back to the data transfer circuitry illustrated in FIG. 2, with respect to the example discussed above, the number of bits $a$ read from the buffer memory 32 by the counter 50 is 200 and the number of needle clear commands is $k$. Thus, the output rate obtained from the rate multiplier 56 will be $k/a$ times the input clock rate. The output rate from rate multiplier 58 will be $(k/a) \times d$ times the same input clock rate.

In the example given, since the factor $a$ is 200 and since there are 1000 needles in the needle cylinder, the buffer memory 32 must be read five times for each sliver feed for the upcoming revolution of the needle cylinder. Thus, the buffer shift register 60 will contain five groups of rate data, each $ma$ bits long. This provides the $(k/a) \times d$ factor for the next succeeding revolution of the needle cylinder, i.e. $(k/200) \times d$ in the example given.

Since, in the example given, the pattern repeat is 300 wales wide, the first cycle of pattern data transferred from the buffer memory 32 to the buffer shift register 60 uses the first 200 bits of pattern data. The second cycle uses the last 100 bits and the first 100 bits of pattern data. The third cycle uses the last 200 bits of pattern data, etc., until all of the pattern data has been transferred to the buffer shift register 60, preparatory to its transmittal, at the appropriate time, to the appropriate active shift register, as previously explained.

By the above described invention, it is possible, in knitting patterned high pile fabric on multi-feed circular knitting machines to control the rate at which sliver is supplied at each feed so that it will harmonize with the rate at which sliver fibers are being used by selected needles cleared at that feed. Sliver is fed only to the extent necessary to satisfy the demand of needles selected to clear. As will be readily understood, depending on the nature of the pattern being knitted, and hence the needle selection employed, the sliver feeding rate at any particular sliver feed might vary, during knitting, anywhere from 0% to 100% of the maximum sliver feed rate available.

With this invention, it is not necessary to incorporate into the main memory 30 sliver feed control data for controlling the rates at which sliver is fed to the needles of the knitting machine at each sliver feeding station. Instead, the needle selection pattern data determines, for each station, the rates of sliver feed by the feed rolls 14, 16 to the main cylinder 12, for delivery via doffer 10 to the knitting machine. The electronic control system calculates continuously and accurately the necessary sliver feeding rates using the pattern data stored by the memory 30. The calculations are carried out by the data transfer electronic circuit interposed between the main memory 30 and each stepping motor 20. For this specific purpose, the circuit includes the buffer memory 32 for the temporary storage of needle selection pattern data, counter 50, multiplier 52, rate multiplier 56 and buffer shift register 60. In addition to using the pattern data retrieved from the memory 30, the data transfer electronic circuit also incorporates into its calculations the selected speed of rotation of the needle cylinder and the selected density of the fabric being knit. The sliver feeding rates thus calculated are translated into trains of pulses which are used to drive each of the several stepping motors 20 at selected speeds. Thus, by means of this invention, the rate of sliver feed at each sliver feeding station is continuously calculated and precisely controlled, to ensure that the sliver input at each station harmonizes with the knitting pattern selected, the speed of rotation of the circle of needles and the desired pile density of the fabric.

Although a preferred embodiment of this invention has been shown and described for the purpose of illustration, as required by Title 35 U.S.C. Para. 112, it is to be understood that various changes and modifications may be made therein without departing from the spirit and utility of the invention, or the scope thereof as set forth in the appended claims.

We claim:

1. In a sliver high pile fabric circular knitting machine having a rotatable circle of independent needles, a plurality of sliver feeding cards spaced about the circle of needles, needle selecting mechanism associated with each card and a yarn feed disposed adjacent selected cards, a. electronic control means operable to cause the needle selecting mechanisms to select needles according to a predetermined needle pattern, b. said control means including a memory for storing knitting pattern data only, c. variable speed drive means associated with each card operable to deliver a sliver to each card at selected rates, and d. a data calculating and transfer electronic circuit interposed between the memory and each variable speed drive means, for receiving knitting pattern data in digital form from the memory, e. said data calculating and transfer electronic circuit including calculating means automatically operative to calculate continuously the speed of each variable speed drive means using the digital knitting pattern data transferred from the memory to the circuit and to regulate the rates of delivery of sliver to the cards, to harmonize sliver input to the knitting machine with the demand of the needles for sliver fibers according to the predetermined needle pattern.

2. The knitting machine of claim 1, wherein a. each card includes a rotatable doffer for feeding sliver fibers to needles of the knitting machine, b. a plurality of cards are associated together in a feed group to provide a multi-sliver patterned pile fabric, c. a yarn feed is associated with each feed group, d. the electronic control means is operable to cause selected needles to clear to receive sliver fibers from the doffers of selected cards of the feed group, and e. the data calculating and transfer electronic circuit is operable to control continuously the variable speed drive means of the cards to deliver sliver to each card at rates in proportion to the number of needles selected to receive sliver fibers from the doffer of each card.

3. The knitting machine of claim 2, wherein a. each card includes a pair of rotatable sliver feed rolls and a rotatable main cylinder interposed between the doffer and the feed rolls, b. a stepping motor is drivingly connected to the feed rolls of each card to drive said feed rolls at selected sliver feeding rates, and c. the data calculating and transfer electronic circuit is connected to each stepping motor, and operable to calculate and control selectively the speed at which each motor drives its feed rolls in accordance with i. the number of needles selected to receive sliver fibers from the doffer, ii. the speed of rotation of the circle of needles, and iii. the desired pile density of the fabric.

4. In a sliver high pile fabric circular knitting machine having a rotatable circle of independent needles, a plurality of sliver feeding stations spaced about the circle of needles, a needle selecting mechanism associated with each station, electronic pattern data control means, including a memory for storing needle selection pattern data in digital form, for controlling the needle selecting mechanisms, and a yarn feed disposed adjacent selected stations, the method of knitting patterned high pile fabric comprising:

a. feeding sliver fibers and yarn to the needles to knit patterned high pile fabric, said sliver fibers being fed at selected rates at each station, b. continuously selecting needles, according to predetermined needle selection pattern data, to receive sliver fibers from selected stations, c. continuously transferring needle selection pattern data from the memory to a data calculating and transfer electronic circuit, said circuit being interposed between the memory and each station, said circuit including calculating means automatically operative to calculate sliver feeding rates for each station, and d. continuously calculating and controlling the rates of sliver feed at each station, utilizing the data transferred from the memory to the circuit, whereby the rate at which sliver is fed at each station harmonizes with the demand of the needles for sliver fibers at such station.

5. The method of claim 4, further including the step of selecting the sliver feed rate for each station at a selected time interval before the change point of the fabric reaches said station.

6. The method of claim 5, wherein the selected time interval comprises a selected number of needles before the change point reaches that station.

7. The method of claim 4, further including the steps of:

a. raising the selected needles to clear level to receive sliver fibers from the selected cards, b. lowering the selected needles to tuck level after they have received sliver fibers, and c. then feeding a yarn to the needles.

8. The method of claim 4, wherein the rate of sliver feed at each sliver feeding station is continuously calculated and controlled, whereby the rate of sliver feed at each station is proportionate to a. the demand of selected needles for sliver fibers in accordance with the predetermined needle selection pattern, b. the speed of rotation of the circle of needles and c. the selected density of the pile of the fabric being knit.

* * * * *

UNITED STATES PATENT OFFICE
CERTIFICATE OF CORRECTION

PATENT NO. : 4,007,607
DATED : February 15, 1977
INVENTOR(S) : Paul Christiansen and George K. Roshon It is certified that error appears in the above-identified patent and that said Letters Patent are hereby corrected as shown below:

Column 1, line 8, change "machines" to --machine--

Column 3, line 16, change "3,940,91" to --3,940,951--

Column 4, line 29, delete "O"

Column 4, line 33, change "20" to --10--

Column 7, line 45, change "(n x d x(k/a) 100" to --(n x d x k/a) 100--

Column 7, line 63, change "m(n x d x (k/a)" to --m(n x d x k/a)--

Column 8, line 62, before "rate" insert --divider 54--

Signed and Sealed this
Third Day of May 1977

[SEAL]

*Attest:*

RUTH C. MASON
*Attesting Officer*

C. MARSHALL DANN
*Commissioner of Patents and Trademarks*